US007414591B1

(12) United States Patent
Lier et al.

(10) Patent No.: US 7,414,591 B1
(45) Date of Patent: Aug. 19, 2008

(54) HELICAL ANTENNA SYSTEM

(75) Inventors: Erik Lier, Newtown, PA (US); Slawomir J. Fiedziuszko, Palo Alto, CA (US); Francis D. Tiziano, Feasterville, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/211,515

(22) Filed: Aug. 26, 2005

(51) Int. Cl.
*H01Q 1/36* (2006.01)

(52) U.S. Cl. ..... 343/895

(58) Field of Classification Search ..... 343/702, 343/895

See application file for complete search history.

(56) References Cited

U.S. PATENT DOCUMENTS

| | | | | |
|---|---|---|---|---|
| 5,341,149 | A * | 8/1994 | Valimaa et al. | 343/895 |
| 5,986,621 | A | 11/1999 | Barts et al. | |
| 6,002,377 | A * | 12/1999 | Huynh et al. | 343/895 |
| 6,285,340 | B1 * | 9/2001 | Park et al. | 343/895 |
| 6,292,156 | B1 * | 9/2001 | Openlander | 343/895 |
| 6,664,929 | B2 * | 12/2003 | Ye | 343/702 |
| 2003/0169208 | A1 * | 9/2003 | Wu | 343/895 |

* cited by examiner

*Primary Examiner*—Tan Ho
(74) *Attorney, Agent, or Firm*—McDermott Will & Emery LLP

(57) ABSTRACT

An antenna system includes a helical antenna that includes one or more helically shaped conductors. Each conductor is substantially embedded in a dielectric structure.

16 Claims, 13 Drawing Sheets

98

| Hole dia (in) | Directivity (dB) | Axial Ratio(dB) |
|---|---|---|
| 0.1 | 11.30 | 4.69 |
| 0.44 | 11.35 | 0.66 |
| 0.88 | 11.43 | 4.18 |
| 1.76 | 11.73 | 3.09 |
| 2.2 | 11.60 | 3.62 |
| 2.64 | 10.86 | 5.73 |
| 3.08 | 11.63 | 2.73 |
| 3.52 | 11.66 | 2.42 |
| 3.96 | 11.32 | 4.04 |
| 4.4 | 10.51 | 5.16 |

HELICAL ANTENNA SYSTEM

STATEMENT AS TO RIGHTS TO INVENTIONS MADE UNDER FEDERALLY SPONSORED RESEARCH OR DEVELOPMENT

Not Applicable.

TECHNICAL FIELD

This disclosure relates to a helical antenna system and, more particularly, to embedding a helical antenna in a dielectric material to reduce antenna size without degrading performance.

BACKGROUND

In many aspects of wireless communications, a desire exists to minimize antenna size. In general, technological progress has produced significant advances in the miniaturization of electronic components and circuitry, however, this progress has not been mirrored by corresponding advancements in antenna miniaturization. Theoretical work over the years, as well empirical results, indicate that reducing antenna size may cause compromises to be made in antenna performance, most notably efficiency and bandwidth. Additionally, antenna directivity, cross-polarization isolation, and other antenna performance characteristics may be sacrificed to reduce antenna size.

SUMMARY OF THE DISCLOSURE

The subject matter disclosed herein solves these problems by providing a helical antenna that is embedded in a dielectric cylinder. Along with providing structural support, by embedding the helical antenna in the dielectric material, the physical dimensions of the antenna may be reduced without substantially degrading antenna performance. In particular, the helical antenna may be scaled as a function of the dielectric constant of the dielectric material. Thus, a reduced size helical antenna may provide the similar directivity as a larger helical antenna that is exposed to free space. Going one step further, the embedded helical antenna may then be extended to the pre-scaled antenna length to increase antenna directivity and improve other performance characteristics.

In accordance with an aspect of the disclosure, an antenna system includes a helical antenna that includes one or more helically shaped conductors. Each conductor is substantially embedded in a dielectric structure.

In one embodiment of the antenna system, the dielectric structure may be substantially shaped as a cylinder or another geometrical shape or combination of shapes. For example, the dielectric structure may be substantially shaped as a tapered cylinder, a solid cylinder, or a hollow cylinder. The dielectric structure may include a groove or other similar channel to embed the conductor. The groove may be placed in various location such as in an outer surface of the dielectric structure. The antenna system may further include another dielectric structure that covers the conductor embedded in the first dielectric structure. This second dielectric structure may have a shape similar to the first dielectric structure such as a cylinder, a tapered cylinder, or other geometrical structure. Various types of dielectric material or materials may be used to produce the dielectric structure. For example, the dielectric structure may include a dielectric material with a dielectric constant of at least 2.0. The dielectric structure may also include two or more a portions in which each portion has a different dielectric constant. The dielectric structure may include Teflon, polystyrene, ceramic, or other similar material.

In accordance with another aspect of the disclosure, an antenna system includes a helical antenna that includes one or more helically-shaped conductors. Each conductor is substantially embedded in a dielectric cylinder.

In one embodiment, the antenna system further includes, another dielectric cylinder in which the first dielectric cylinder may be inserted within the second dielectric cylinder to cover the embedded conductor. Or the second dielectric cylinder may be inserted within the first dielectric cylinder to cover the embedded conductor. The dielectric cylinders may implement various geometries such as a taper shape. Additionally, the dielectric cylinders may include one or more grooves for holding the conductor.

Additional advantages and aspects of the present disclosure will become readily apparent to those skilled in the art from the following detailed description, wherein embodiments of the present invention are shown and described, simply by way of illustration of the best mode contemplated for practicing the present invention. As will be described, the present disclosure is capable of other and different embodiments, and its several details are susceptible of modification in various obvious respects, all without departing from the spirit of the present disclosure. Accordingly, the drawings and description are to be regarded as illustrative in nature, and not as limitative.

DETAILED DESCRIPTION OF THE EMBODIMENTS

Figure 1:
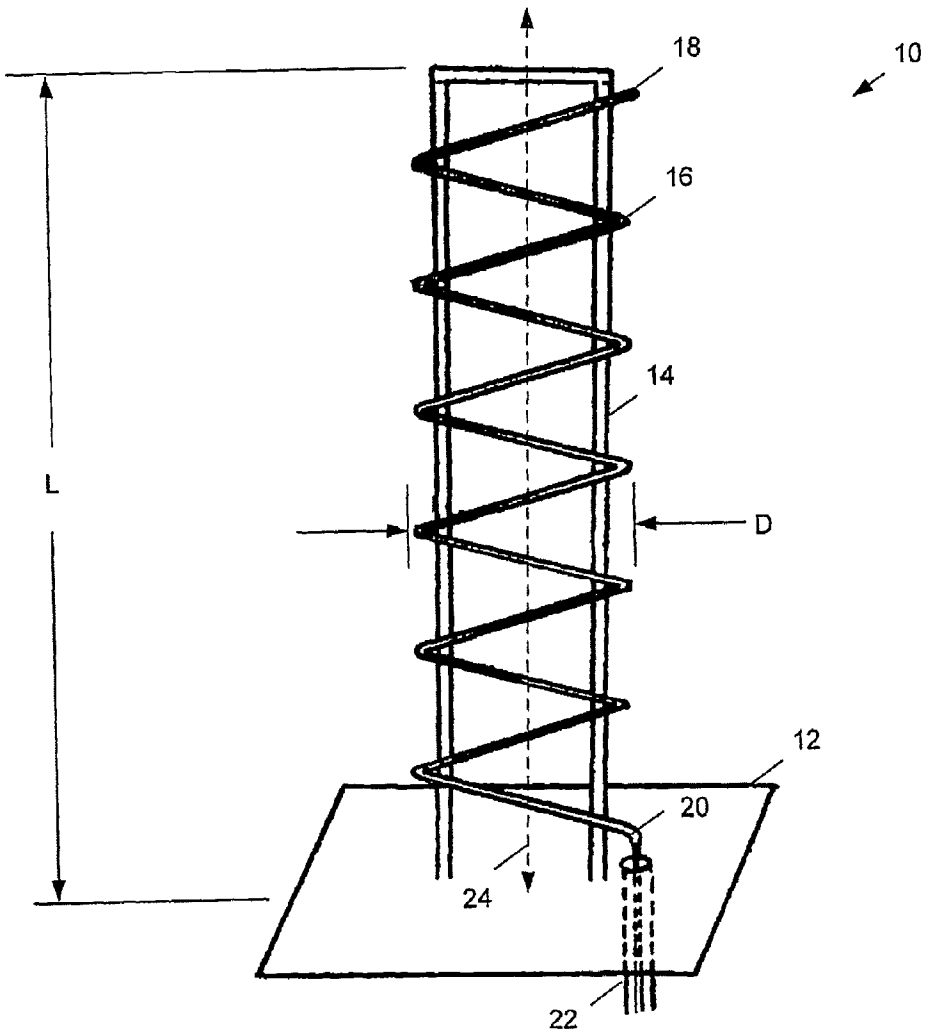
FIG. 1 is a diagrammatic view of a conventional helical antenna.

Referring to FIG. 1, a conventional helical antenna 10 includes a ground plane 12 upon which a support structure 14 is attached (e.g., bolted, welded, etc.). A conductor 16 is wrapped around support structure 14 in a spiral manner to produce a helical antenna element that may radiate or receive electromagnetic signals. Typically one end 18 of conductor 16 is terminated at the upper portion of support structure 14 and an opposing end 20 of conductor 16 is connected to a signal feed 22 that transfers electromagnetic signals to and/or from the antenna for reception or transmission. When used for transmission, helical antennas such as helical antenna 10 radiate a substantial portion of electromagnetic energy along an axis 24 of the helix that is created by conductor 16. This type of radiation pattern is typically referred to as an "end-fire" radiation pattern. Alternatively, if used for receiving electromagnetic signals, helical antenna 10 provides maximum reception along axis 24. Additionally, due to the helical geometry of conductor 16, helical antennas such as antenna 10 typically radiate or receive circularly polarized electromagnetic signals.

However, along with providing these advantageous antenna characteristics, the size and geometry of helical antenna 10 also constrains antenna performance. For example, the diameter (labeled D) of the helical portion of antenna 10 is proportional to its circumference that is approximately equal to the center operational wavelength (of the corresponding center frequency) of the antenna. Additionally, the axial length (labeled L) of the helical portion affects the directivity of the antenna. In particular, as the axial length is extended, the directivity of the antenna increases for the end-fire angle. Thus, constraining the size of helical antenna 10 for a particular environment may adversely affect the performance of the antenna. For example, if helical antenna 10 is designed for deployment on a small platform such as a satellite, antenna performance may degrade due to size constraints of the helix diameter and axial length.

Figure 2:
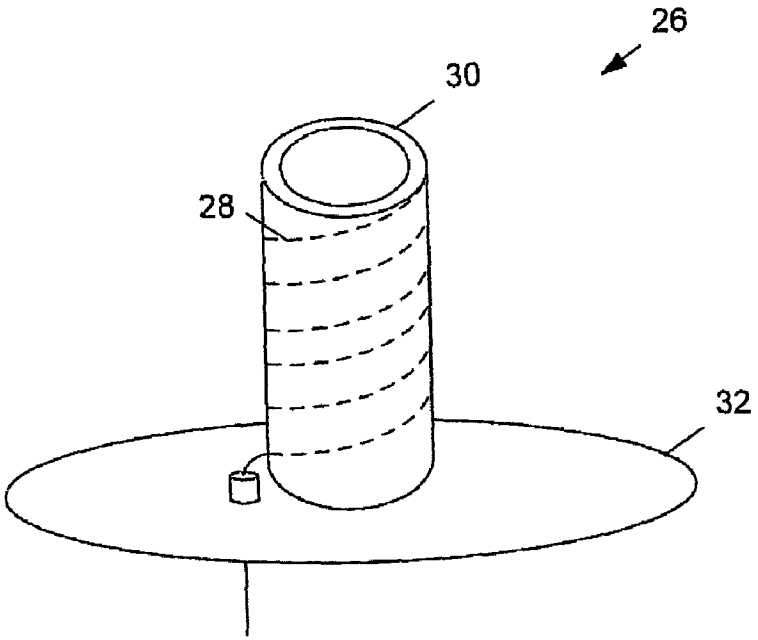
FIG. 2 is a diagrammatic view of a helical antenna system in which a helical-shaped conductor is embedded in a dielectric cylinder

Referring to FIG. 2, a helical antenna 26 is presented in which a conductor 28 is embedded in a cylinder 30 of dielectric material. By embedding conductor 28 in a dielectric material, the wavelengths of the transmitted and/or received electromagnetic signals are scaled dependent upon the properties of the dielectric material. Typically, the wavelength of an electromagnetic signal propagating through the dielectric material is scaled by the square root of the relative permittivity, $\in_r$, (i.e., real portion of the complex dielectric constant) of the material $$\left(\text{i.e., scale facter} = \sqrt{\varepsilon_r}\right).$$

Due to this scaling, a longer wavelength signal (or corresponding lower frequency signal) is transmitted (or received) by the antenna. Thus, by scaling the physical dimensions of the helical antenna by the inverse of the scale factor $$\left(\text{i.e., scale facter} = \frac{1}{\sqrt{\varepsilon_r}}\right),$$

the size of the antenna is reduced while still transmitting (or receiving) an electromagnetic signal at the pre-scaled wavelength. Typically, the physical dimensions of just the helically-shaped conductor 28 and dielectric cylinder 30 are reduced by the scale factor $$\frac{1}{\sqrt{\varepsilon_r}},$$

however in some applications a ground plane 32 that is connected to the helical antenna is also scaled.

By reducing the size of helical antenna 26, less real estate is needed to deploy the antenna. For example, by scaling the physical dimensions, helical antenna 26 needs less satellite payload space $$\left(\text{volume reduced by } \sqrt[3]{\varepsilon_r}\right).$$

Furthermore, for antenna array applications, by reducing the size of each helical antenna array element, the separation distance among the individual antennas may be increased. By increasing this separation distance, mutual signal coupling decreases among the individual antenna elements included in the array.

As will be discussed in detail below, once the physical dimensions of the helical antenna are scaled to reduce the size of the antenna, some dimensions of the antenna may be extended to improve performance. In particular, directivity of the antenna may be increased by extending the axial length of the smaller, scaled antenna. Along with improved directivity, by incorporating additional turns to extend the axial length, cross-polarization of the antenna is also improved. So, if allowed by the physical constraints of the platform, the embedded helical antenna may provide increased directivity and improved cross-polarization compared to a conventional helical antenna that is constrained by the same platform or environment.

A number of design variations may be implemented to embed a helical antenna into a dielectric structure such as a cylinder or other geometry. For example, dielectric cylinder 30 may be designed with different geometries. For example, a solid cylindrical geometry or a hollow cylindrical geometry may be implemented. To embed the one or more conductors that form the helical antenna in the dielectric material, various techniques known to one skilled in the art of tooling and manufacturing may be implemented. As described below and shown in the following figures, the dielectric cylinder may be implemented with one or multiple layers. Furthermore, the dielectric cylinder may be produced from one type of dielectric material or multiple types of dielectric material.

Figure 3:
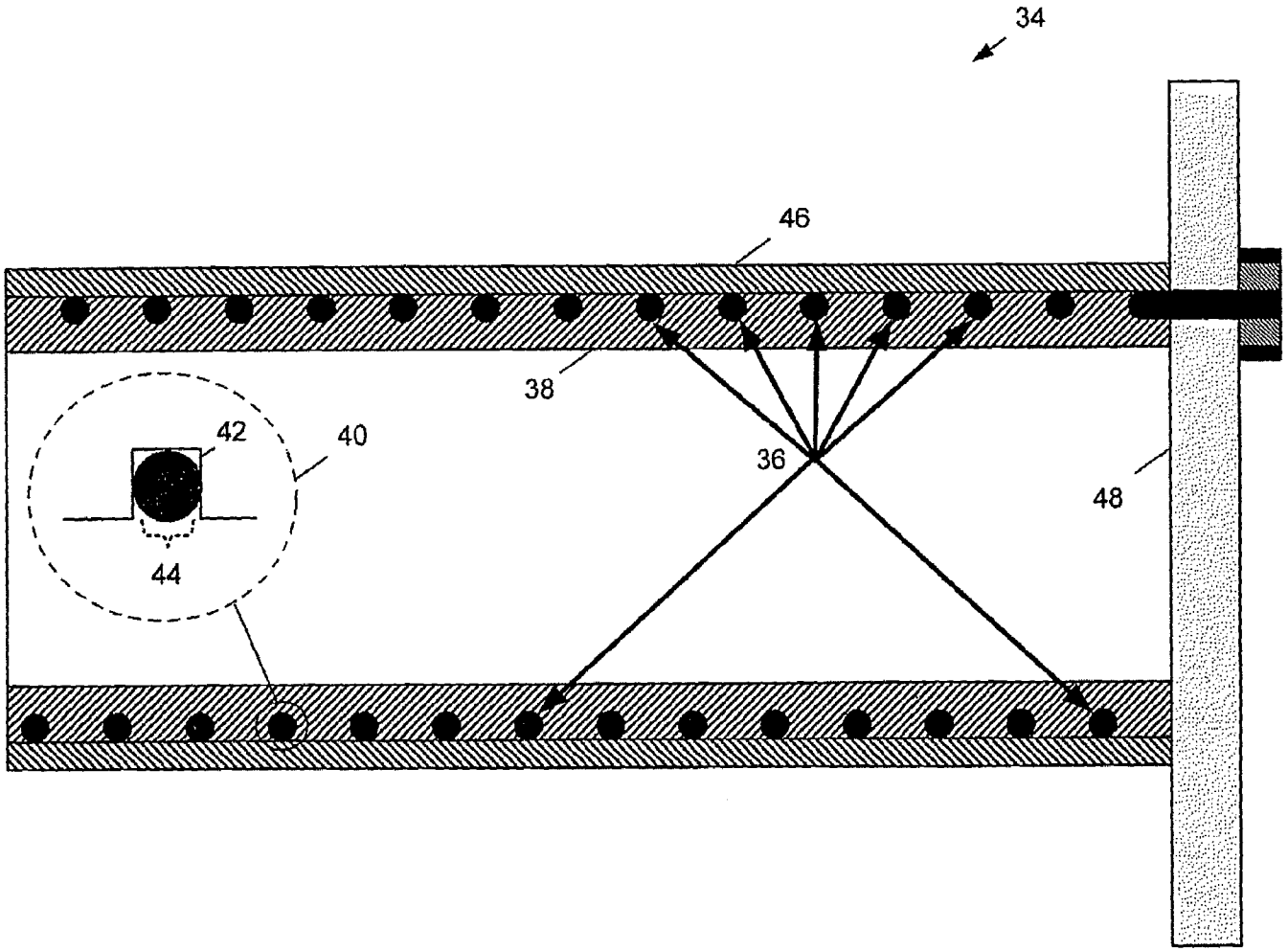
FIG. 3 is a cross-sectional view of a helical antenna system shown in FIG. 2.

Referring to FIG. 3, a cross-sectional view along the center axis of an embedded helical antenna 34 is shown. In this arrangement, a conductor 36 is positioned in a spiral groove that is cut into an outer wall of an inner dielectric cylinder 38. As shown in an exploded view 40, in this exemplary design, a square groove 42 is cut into the dielectric cylinder. This square groove (or grooves) holds conductor 36 in a substantially spiral shape to provide the helical geometry of the antenna. Once positioned in square groove 42, a portion 44 of conductor 36 remains exposed. To cover this exposed portion (so that the entire conductor is encased by dielectric material), an outer dielectric cylinder 46 is positioned over inner dielectric cylinder 38. In this example, outer dielectric cylinder 46 entirely covers inner dielectric cylinder 38 and is in contact with a ground plane 48, however, in some arrangements, the outer cylinder may partially cover the inner cylinder.

Inner dielectric cylinder 38 and outer dielectric cylinder 46 may be produced from similar or different dielectric materials. For example, the dielectric material may include Teflon™, Polystyrene™, or other similar lightweight material. Typically the dielectric materials have a dielectric constant that approximately ranges between 2.0 and 4.0. However, in some applications, dielectric materials with dielectric constants as large as 30.0 to 40.0 or even higher may be used. Other types of dielectric material may be used for other antenna applications. For example, either or both of the cylinders may be produced from a ceramic material for high power transmission applications. In this arrangement, the square grooves cut into inner dielectric cylinder 38 are sized to substantially match the diameter of conductor 36. However, in other arrangements, grooves of different geometries may be implemented.

Figure 4:
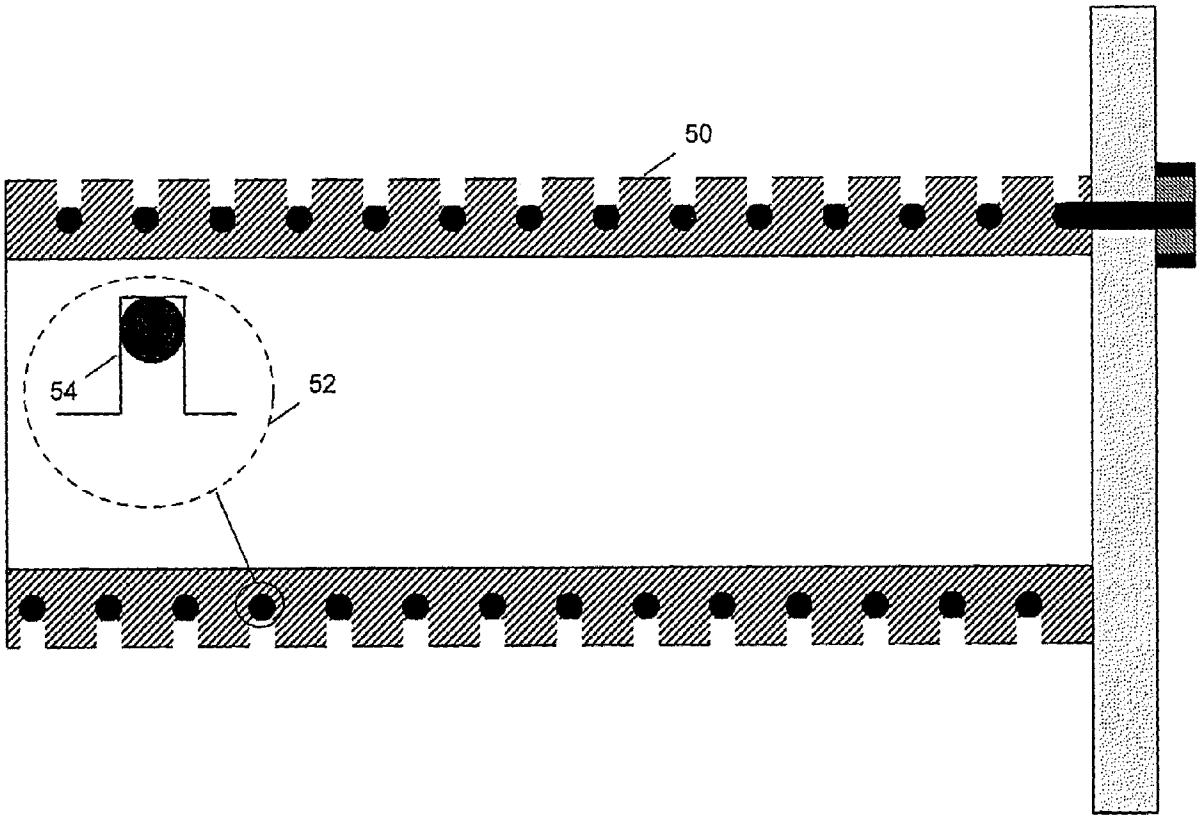
FIG. 4 is a cross-sectional view of another embodiment of an embedded helical antenna system in which a helical-shaped conductor is embedded within an outer wall of a dielectric cylinder.

Referring to FIG. 4, in one design variation, deeper grooves may be cut into an inner dielectric cylinder 50. As shown in an exploded view 52, a square-shaped groove 54 is cut into the outer wall of an inner dielectric cylinder 50. In comparison to groove 42 (shown in FIG. 3), groove 54 extends deeper into the cylinder material. In the exemplary designs shown in FIGS. 3 and 4, grooves are cut into the outer walls of inner dielectric cylinders. However, in other arrangements, grooves may be cut into a surface of an outer dielectric cylinder (that covers an inner dielectric cylinder) or into inner and outer dielectric cylinders.

Figure 5:
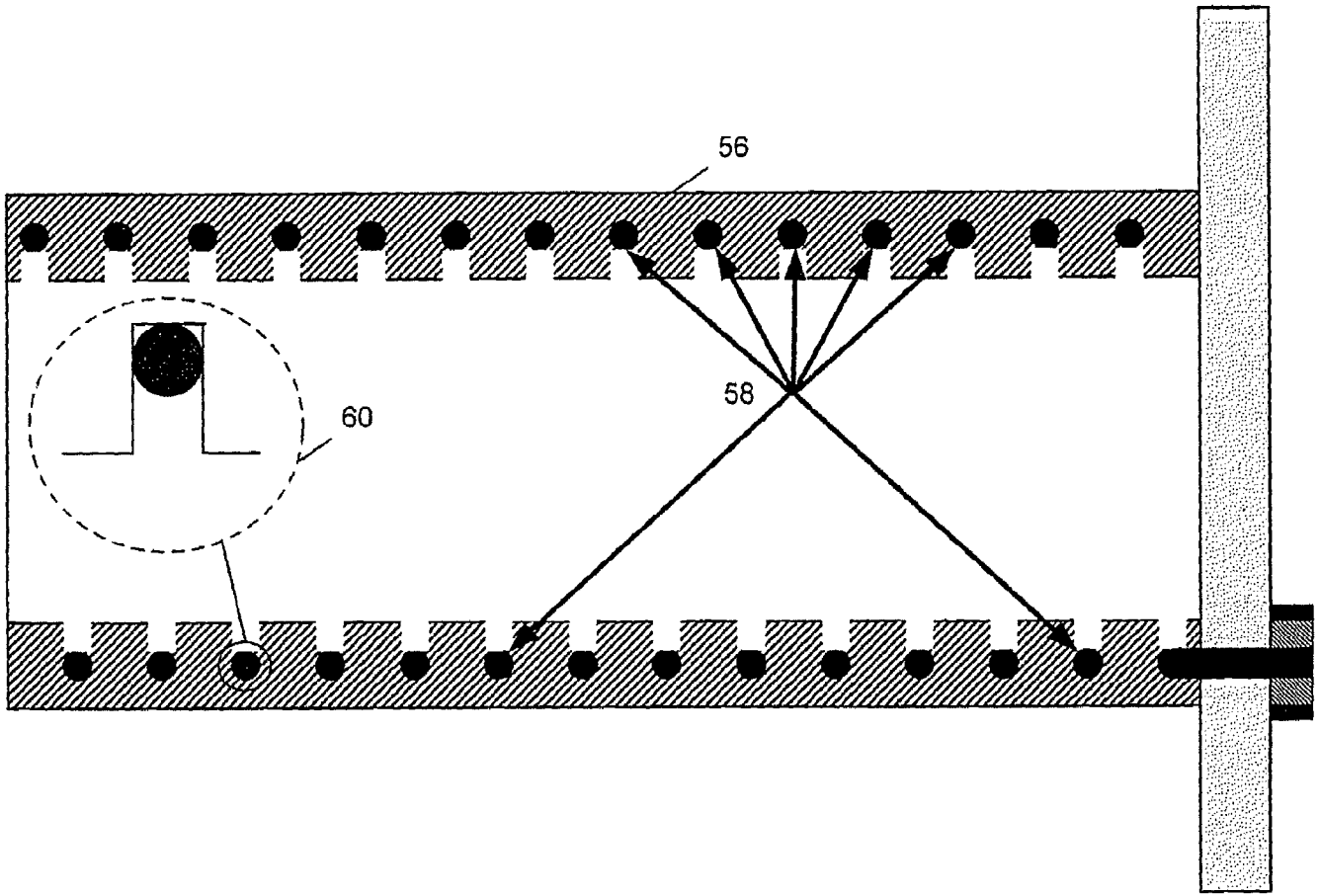
FIG. 5 is a cross-sectional view of another embodiment of an embedded helical antenna system in which a helical-shaped conductor is embedded within an inner wall of a dielectric cylinder.

Referring to FIG. 5, in one exemplary design of an outer dielectric cylinder 56, one or more grooves are cut into an inner wall to hold a helical-shaped conductor 58. As shown in an exploded view 60, the groove cut into the outer cylinder has a depth similar to the groove shown in FIG. 4. However, as mentioned above, various groove shapes and sizes may be implemented. Furthermore, along with implementing different types of grooves, different geometries may be incorporated into the inner and/or outer dielectric cylinders.

Figure 6:
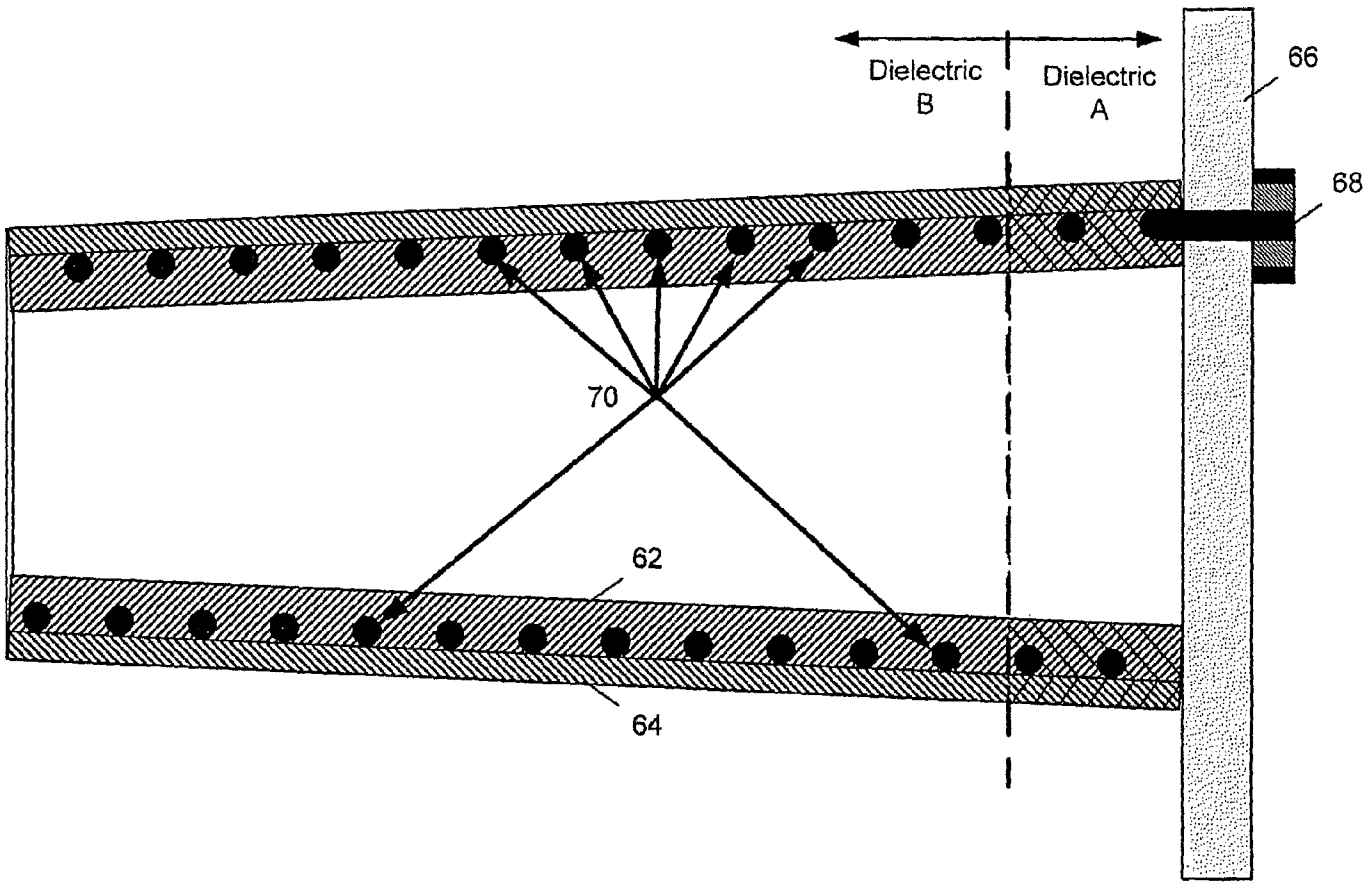
FIG. 6 is a cross-sectional view of an embedded helical antenna system in which a helical-shaped conductor is embedded in a tapered dielectric cylinder that includes multiple types of dielectric materials.

Referring to FIG. 6, a tapered geometry is incorporated into an inner dielectric cylinder 62 and an outer dielectric cylinder 64. In general, two electromagnetic modes are associated with the a helical antenna. The first mode is an axial mode and the second mode radiates parallel to the ground plane of the antenna. By implementing such a tapered geometry, the electromagnetic mode parallel to the ground plane is suppressed. Thereby, side-lobe levels are reduced for both transmission and reception applications. Additionally, in this implementation, two types of dielectric material are incorporated into the tapered cylinders. For example, one type of dielectric may be incorporated into a region of the cylinders that is located near an antenna feed 68. This type of dielectric material (labeled "Dielectric A") may be capable of sustaining high temperatures that are produced from a transmission signal that emerges from feed 68. As the signal continues to propagate along a helical-shaped conductor 70, the temperature may lower in comparison to the temperature present near feed 68. As such, a different dielectric (labeled "Dielectric B") may be incorporated into a region of the dielectric cylinders 62 and 64 that is relatively distant from feed 68.

Figure 7:
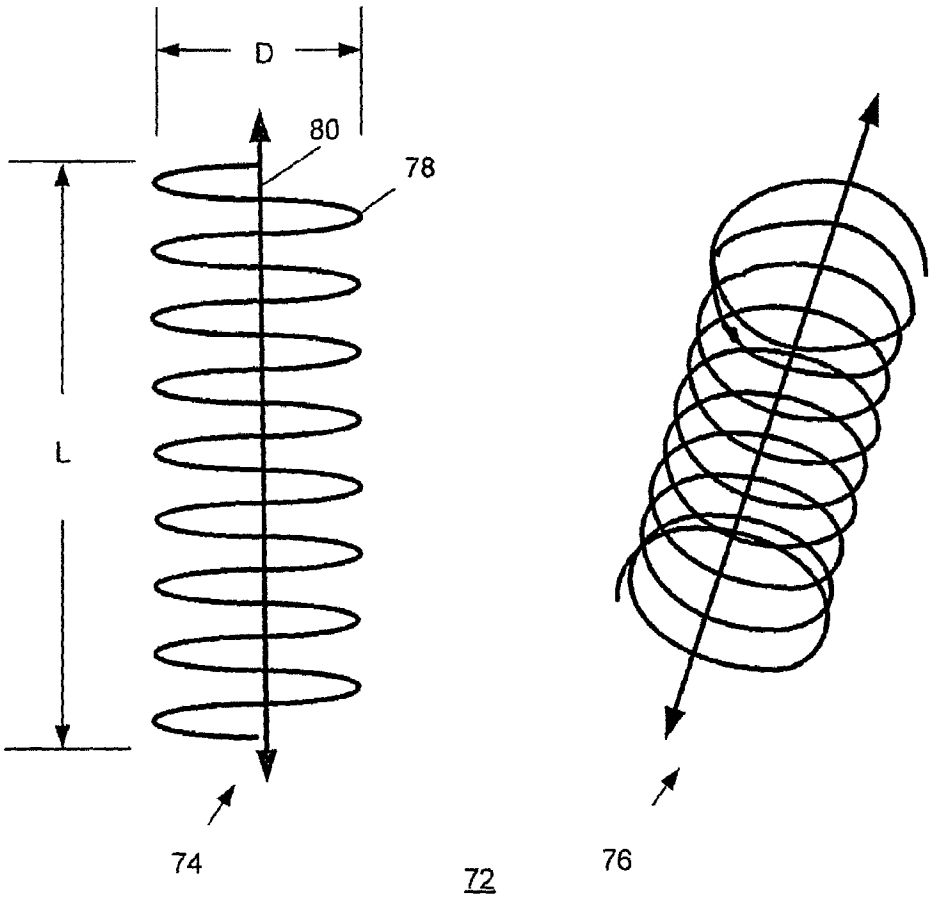
FIG. 7 includes diagrammatic views of a three-dimensional model of a conventional helical antenna system.

Referring to FIG. 7, to illustrate size and performance improvements, a numerical model 72 of a conventional helical antenna is presented. In particular, two different views 74, 76 of the numerical model are shown. This conventional helical antenna includes a single conductor 78 that spirals about a center axis 80 to produce the helical shape of the antenna. Conductor 78 is completely exposed to free space and, for this example, the helical shape produced by the conductor has a diameter (D) of 4.8 inches and length (L) of 41.0 inches.

To quantify the performance of the helical antenna represented by numerical model 72, the model is provided to an electromagnetic simulation analysis software package such as HFSS™ (produced and marketed by Ansoft Corporation of Pittsburgh, Pa.). Various types of numerical simulations may be executed to quantify antenna performance. For example, antenna directivity pattern versus angle provides a measure of transmission and reception performance. By computing the antenna directivity for numerical model 72, which represents a conventional helical antenna, a baseline may be established for comparing the performance of a numerical model that represents a helical antenna embedded in a dielectric cylinder.

Figure 8:
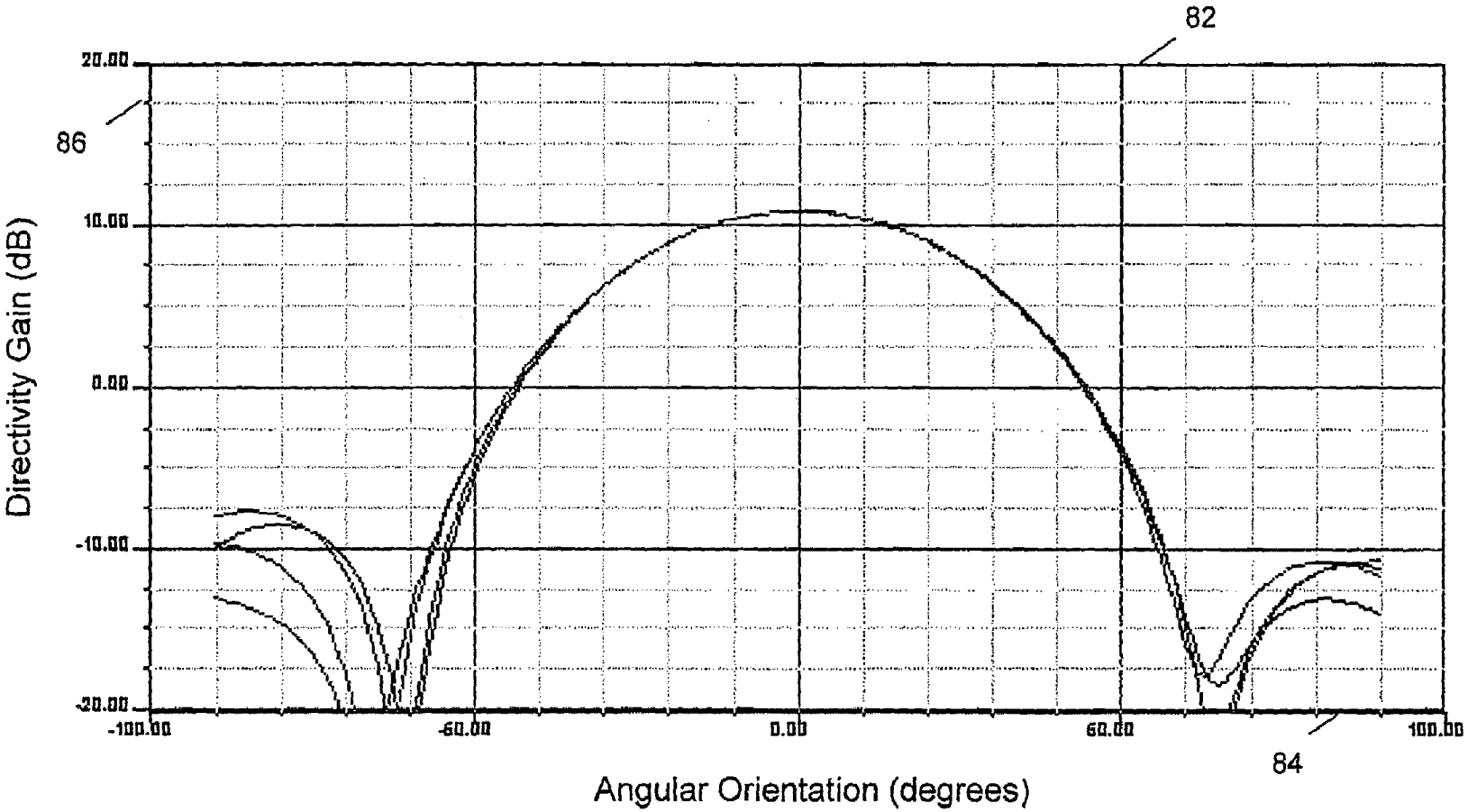
FIG. 8 is a chart that represents antenna directivity pattern versus angle for the conventional helical antenna system shown in FIG. 7.

Referring to FIG. 8, a chart 82 is presented that provides antenna directivity versus angle of the conventional helical antenna that is represented by number 72 (shown in FIG. 7). In particular, an x-axis 84 provides an angular range. Zero degree represents the end-fire angle of the antenna. Angles with negative degrees (e.g., −1° to −100°) represent angular positions to the left of the end-fire position and positive degrees (e.g., −1° to −100°) represent angles to the right of the end-fire position. The computed directivity of the antenna is represented on a y-axis 86. For this exemplary chart, the y-axis has a logarithmic scale with units of decibels (dB). Four computations were executed at four different signal frequencies. Correspondingly, four traces on the chart represent the computed antenna directivity for each of the four signal frequencies. The directivity for each signal are similar and are approximately equivalent in the angular region (e.g., −60° to +60°) near the end-fire angle. As shown in the chart, the maximum antenna directivity (i.e., approximately 11 dB) is located at the end-fire angle (i.e., approximately 0°). Since this antenna gain represents the response of a conventional helical antenna, the data contained within the chart may be used as a baseline to demonstrate performance improvements provided by embedding the helical antenna in a dielectric material.

Figure 9:
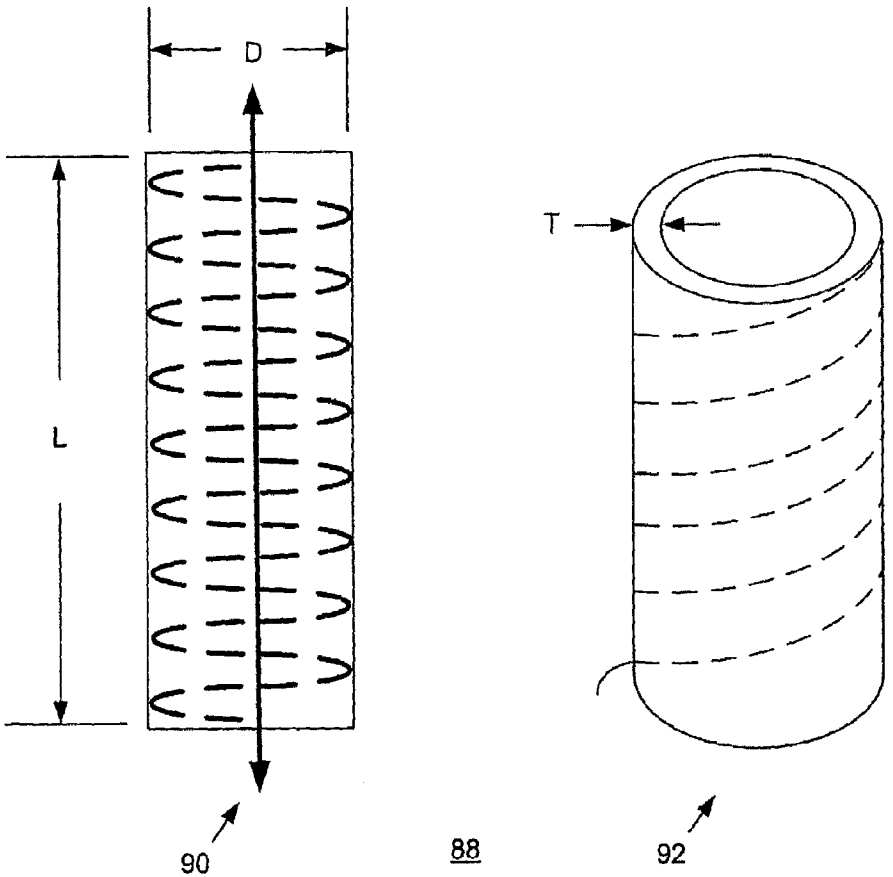
FIG. 9 includes diagrammatic views of a three-dimensional model of a helical antenna system embedded in a dielectric cylinder.

Referring to FIG. 9, a numerical model 88 of a helical antenna embedded in a dielectric cylinder is shown. In particular, two views 90, 92 of the antenna are presented. In this arrangement, the dielectric cylinder is hollow and has a thickness (T). Since the electromagnetic fields that radiate from a helical antenna are substantially located near the conductor that produces the antenna, dielectric material that is located along the center axis of the antenna (and correspondingly along the center axis of the dielectric cylinder) may be removed. As mentioned above, due to the dielectric material, the physical dimensions of the helical antenna may be scaled $$\left(\text{by a scale factor} = \frac{1}{\sqrt{\varepsilon_r}}\right)$$

still operate at (e.g., transmit or receive) at the pre-scaled wavelength. In this example, the dielectric material of the dielectric cylinder has a relative permittivity of 2.55 and the scale factor calculates to be 0.62. Thereby, the length (L) of the antenna is scaled to 25.7 inches (from 41.0 inches) and the antenna diameter scales down in 3.0 inches (from 4.8 inches). Thus, the overall size of the antenna is reduced, but the operating center frequency of the antenna approximately remains equivalent to the center frequency of the antenna represented in FIG. 7. So, by using numerical model 88, which represents an embedded helical antenna, the electromagnetic simulation analysis software package can be used to compute an antenna directivity.

Figure 10:
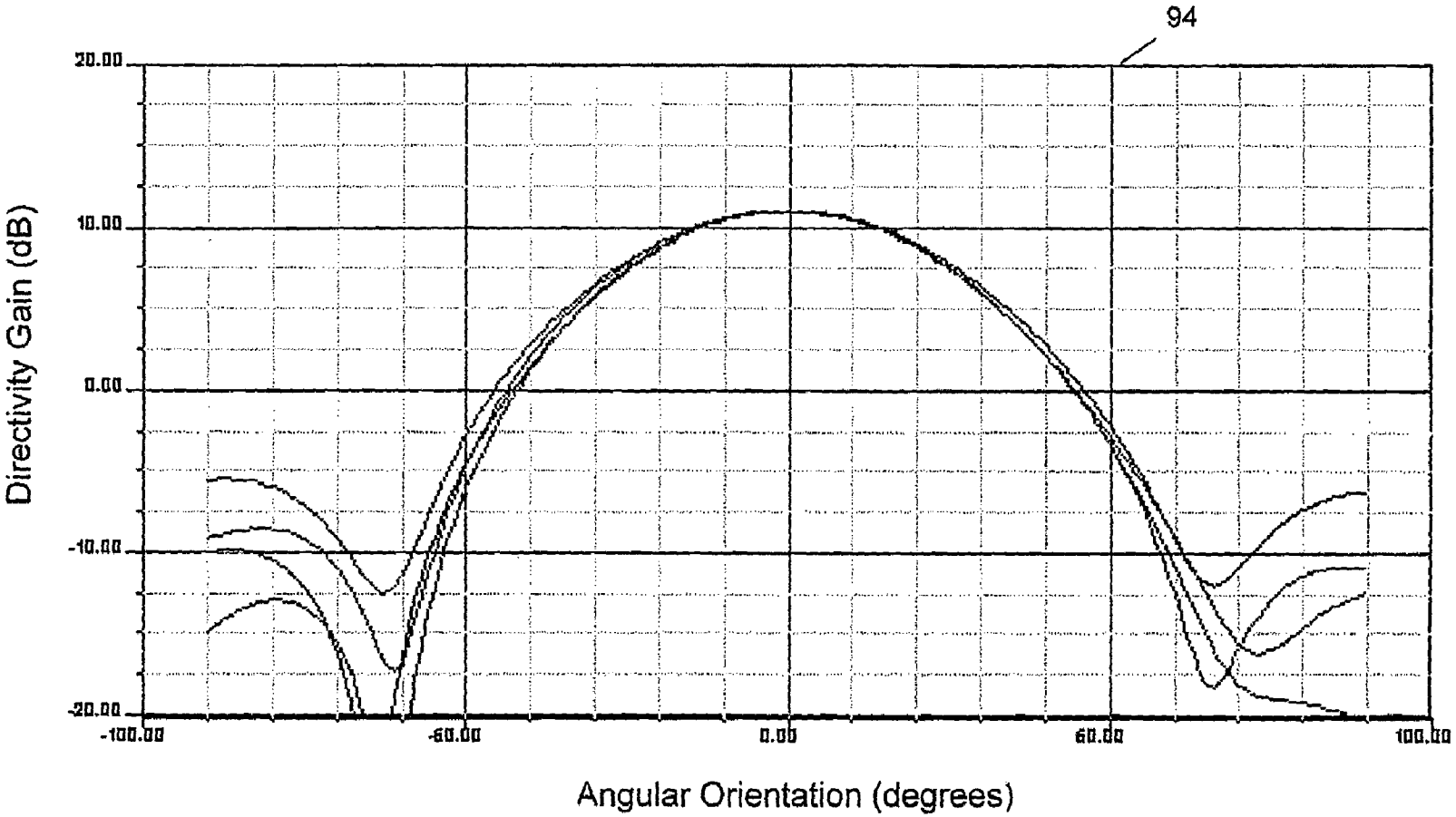
FIG. 10 is a chart that represents antenna directivity pattern versus angle for the embedded helical antenna system shown in FIG. 9.

Referring to FIG. 10, a chart 94 provides antenna directivity pattern versus angle computed for the embedded helical antenna model shown in FIG. 9. Chart 94 includes the same axis and numerical ranges as chart 82 (shown in FIG. 8). As shown in the chart, for multiple signal frequencies, the directivity of the embedded helical antenna is substantially equivalent to the antenna directivity shown in FIG. 8. In particular, at the end-fire angular region (i.e., approximately 0°) the antenna has a directivity of approximately 11 dB. Referring briefly back to FIG. 8, the antenna directivity at the end-fire angular region for the conventional helical antenna is also approximately 11 dB. Furthermore, the antenna directivity shown in FIGS. 8 and 10 are approximately equivalent. Thus, the performance of embedded helical antenna with scaled physical dimensions is approximately equivalent to the performance of the full-size conventional helical antenna. Furthermore, if not constrained by a platform, one or more of the physical dimensions of the embedded antenna may be extended to improve performance. For example, as mentioned above, the length of the antenna may be extended to include additional conductor turns in the helix. These additional turns improve antenna directivity along with cross-polarization suppression.

Figure 11:
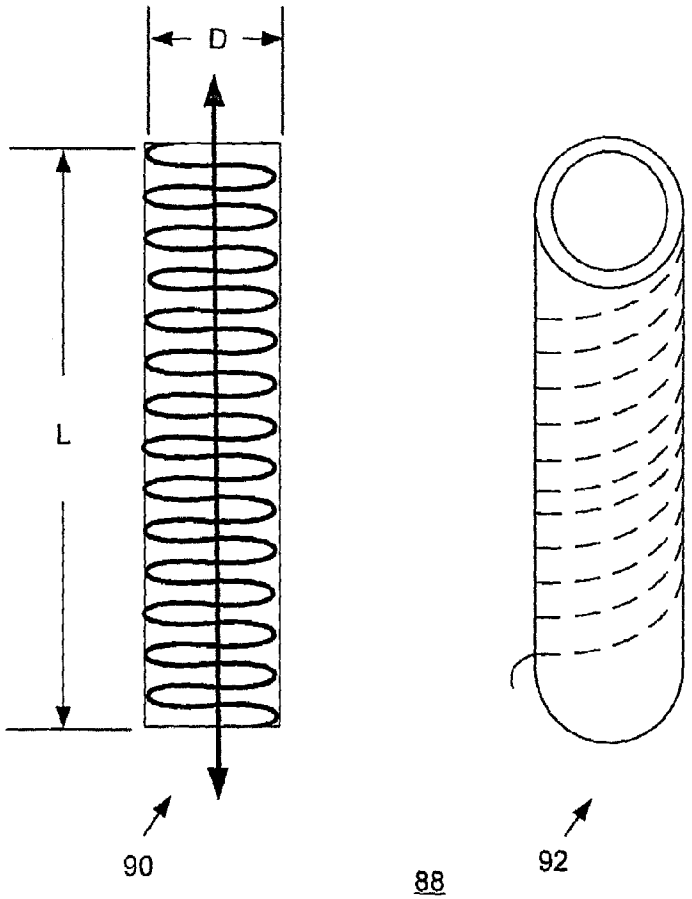
FIG. 11 includes diagrammatic views of a three-dimensional model of an embedded helical antenna system that is extended to the length of the conventional helical antenna shown in FIG. 7.

Referring to FIG. 11, a numerical model 88 of an extended-length helical antenna that is embedded in a dielectric cylinder is shown. Two views 90 and 92 of numerical model 88 are presented. In particular, the length of antenna is extended to the length of the conventional helical antenna that is represented by numerical model 72 (shown in FIG. 7). The length (L) of the embedded antenna is 41.0 inches, however, the diameter (D) of the embedded antenna remains at 3.0 inches (the scaled diameter of numerical model 88 shown in FIG. 9). By increasing the length of the embedded antenna, additional spiral turns are incorporated into the antenna to increase directivity and cross-polarization suppression.

Figure 12:
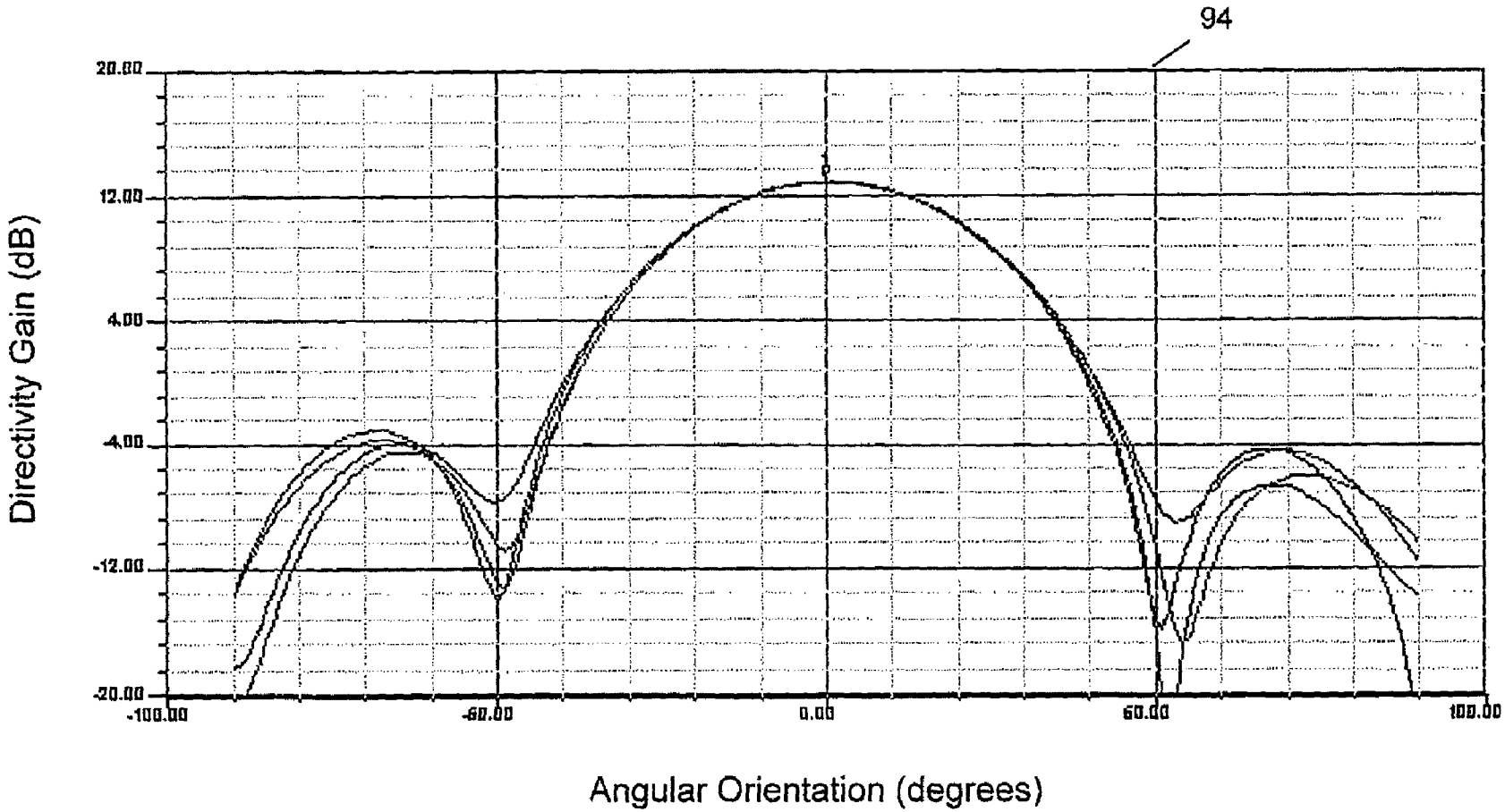
FIG. 12 is a chart that represents antenna directivity pattern versus angle for the embedded helical antenna system shown in FIG. 11.

Referring to FIG. 12, a chart 94 provides antenna directivity pattern versus angle computed for the embedded helical antenna model 88 with an extended length (that was shown in FIG. 11). Chart 94 includes the same axis and numerical ranges as chart 82 (shown in FIG. 8). As shown in the chart, for multiple signal frequencies, a directivity increase is provided by extending the length of the of the embedded helical antenna. In particular, at the end-fire angular region (i.e., approximately 0°) the antenna has a directivity of approximately 13 dB. Referring briefly back to FIG. 8, the antenna directivity at the end-fire angular region for the conventional helical antenna is approximately 11 dB. Thus, by extending the length of the embedded helical antenna approximately provides a 2 dB increase in antenna directivity. Along with extending the length (or other physical dimension) of the helical antenna embedded in dielectric material, other geometrical alterations may be made to the dielectric material or the dielectric cylinder.

Figure 13:
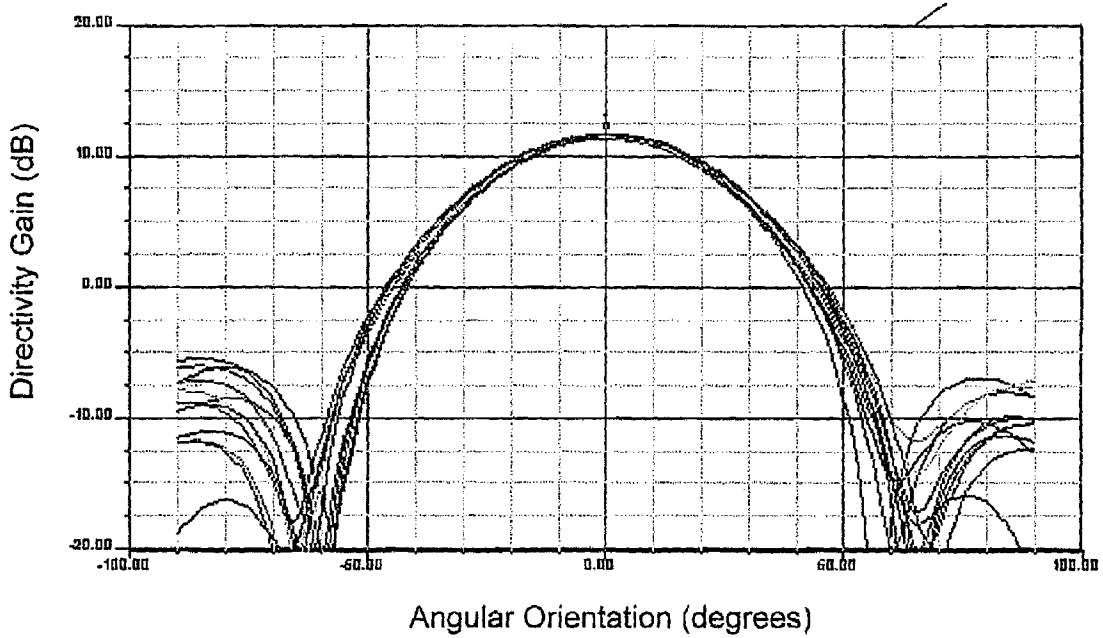
FIG. 13 is a chart that represents antenna directivity pattern versus angle for the embedded helical antenna system shown in FIG. 9. in which wall thickness of the dielectric cylinder is varied.

Referring to FIG. 13, a chart 96 provides computed antenna directivity versus angle for the embedded helical antenna model 88 shown in FIG. 9. A number of data traces are presented on chart 96. Each individual trace represents a helical antenna that is embedded in a hollow dielectric cylinder with a different inner hole diameter. In particular, as presented in table 98, the hole diameters range from 0.1 inch to 4.4 inches and traces are provided on chart 96 for hold diameters of 0.44, 2.2, and 3.96 inches. The antenna directivity at the end-fire angle are provided in chart 98. As provided by chart 96, the directivity does not vary by a significant amount (e.g., approximately 1 dB) across the entire range of the hole diameters. As mentioned above, since radiating electromagnetic energy is predominating located near the conductor that produces the antenna, some hole diameters should not effect the directivity of the antenna. Thus, while the length of the embedded helical antenna has a significant effect on antenna directivity, the diameter of the inner hole of the dielectric cylinder does not have a significant affect. Furthermore, by reducing the mass of the dielectric cylinder by increasing the size of a hole along the center axis of the cylinder, the weight carried by a deployment platform such as a satellite is reduced.

A number of implementations have been described. Nevertheless, it will be understood that various modifications may be made. Accordingly, other implementations are within the scope of the following claims.

What is claimed is:

1. An antenna system, comprising:

a helical antenna including at least one helically shaped conductor;

a first hollow dielectric cylinder having a groove formed in an outer surface, wherein the conductor is substantially embedded in the groove of said first hollow dielectric cylinder; and a second hollow dielectric cylinder, wherein said first hollow dielectric cylinder is configured to be inserted within said second hollow dielectric cylinder to cover the embedded conductor.

2. The antenna system of claim 1, wherein the first hollow dielectric cylinder is substantially shaped as a tapered cylinder, and wherein said second hollow dielectric cylinder is substantially shaped as a tapered cylinder.

3. The antenna system of claim 1, wherein at least one of said first hollow dielectric cylinder and said second hollow dielectric cylinder has a dielectric constant of at least 2.0.

4. The antenna system of claim 1, wherein the first hollow dielectric cylinder includes a first dielectric portion and a second dielectric portion, wherein the first and second portions have different dielectric constants.

5. The antenna system of claim 1, wherein at least one of said first hollow dielectric cylinder and said second hollow dielectric cylinder includes polystyrene.

6. The antenna system of claim 1, wherein at least one of said first hollow dielectric cylinder and said second hollow dielectric cylinder includes ceramic.

7. The antenna system of claim 1, wherein said first hollow dielectric cylinder and said second hollow dielectric cylinder have different dielectric constants.

8. The antenna system of claim 1, wherein said second hollow dielectric cylinder includes a first dielectric portion and a second dielectric portion, wherein the first and second portions have different dielectric constants.

9. An antenna system, comprising:

a helical antenna including at least one helically-shaped conductor;

a first hollow dielectric cylinder having a groove formed in an inner surface, wherein the conductor is substantially embedded in the groove of said first hollow dielectric cylinder; and a second dielectric cylinder, wherein the second dielectric cylinder is configured to be inserted within the first hollow dielectric cylinder to cover the embedded conductor.

10. The antenna system of claim 9, wherein the first hollow dielectric cylinder is tapered, and wherein said second dielectric cylinder is tapered.

11. The antenna system of claim 9, wherein at least one of said first hollow dielectric cylinder and said second hollow dielectric cylinder has a dielectric constant of at least 2.0.

12. The antenna system of claim 9, wherein said first hollow dielectric cylinder includes a first dielectric portion and a second dielectric portion, wherein the first and second portions have different dielectric constants.

13. The antenna system of claim 9, wherein said second hollow dielectric cylinder includes a first dielectric portion and a second dielectric portion, wherein the first and second portions have different dielectric constants.

14. The antenna system of claim 9, wherein at least one of said first hollow dielectric cylinder and said second hollow dielectric cylinder includes polystyrene.

15. The antenna system of claim 9, wherein at least one of said first hollow dielectric cylinder and said second hollow dielectric cylinder includes ceramic.

16. The antenna system of claim 9, wherein said first hollow dielectric cylinder and said second hollow dielectric cylinder have different dielectric constants.

* * * * *